US009839114B2

(12) United States Patent
Benson et al.

(10) Patent No.: US 9,839,114 B2
(45) Date of Patent: Dec. 5, 2017

(54) LINEAR ACCELERATOR ACCELERATING MODULE TO SUPPRESS BACK-ACCELERATION OF FIELD-EMITTED PARTICLES

(71) Applicant: JEFFERSON SCIENCE ASSOCIATES, LLC, Newport News, VA (US)

(72) Inventors: Stephen V. Benson, Yorktown, VA (US); Frank Marhauser, Yorktown, VA (US); David R. Douglas, Yorktown, VA (US); Lucas J. P. Ament, Philadelphia, PA (US)

(73) Assignees: JEFFERSON SCIENCE ASSOCIATES, LLC, Newport News, VA (US); ASML. NETHERLANDS B.V., Veldhoven (NL)

( * ) Notice: Subject to any disclaimer, the term of this patent is extended or adjusted under 35 U.S.C. 154(b) by 0 days.

(21) Appl. No.: 15/260,101

(22) Filed: Sep. 8, 2016

(65) Prior Publication Data

US 2017/0071054 A1 Mar. 9, 2017

Related U.S. Application Data

(60) Provisional application No. 62/215,870, filed on Sep. 9, 2015.

(51) Int. Cl.
*H05H 7/08* (2006.01)
*H05H 9/00* (2006.01)
(Continued)

(52) U.S. Cl.
CPC ..... *H05H 7/08* (2013.01); *H05H 7/02* (2013.01); *H05H 7/18* (2013.01); *H05H 9/00* (2013.01);
(Continued)

(58) Field of Classification Search
CPC .. H05H 7/08; H05H 7/02; H05H 7/18; H05H 7/22; H05H 9/00; H05H 9/02; H05H 9/04
(Continued)

(56) References Cited

U.S. PATENT DOCUMENTS 3,403,346 A * 9/1968 Giordano ..... H05H 9/04 313/359.1
5,124,664 A * 6/1992 Cade ..... H01J 25/10 313/309
(Continued)

OTHER PUBLICATIONS

J. Benesch, "A Plague of Field Emission—17.3 Years of CEBAF Experience", JLab Seminar Series, talk, Feb. 2013.
(Continued)

*Primary Examiner* — Thai Pham

(57) ABSTRACT

A method for the suppression of upstream-directed field emission in RF accelerators. The method is not restricted to a certain number of cavity cells, but requires similar operating field levels in all cavities to efficiently annihilate the once accumulated energy. Such a field balance is desirable to minimize dynamic RF losses, but not necessarily achievable in reality depending on individual cavity performance, such as early $Q_0$-drop or quench field. The method enables a significant energy reduction for upstream-directed electrons within a relatively short distance. As a result of the suppression of upstream-directed field emission, electrons will impact surfaces at rather low energies leading to reduction of dark current and less issues with heating and damage of accelerator components as well as radiation levels including neutron generation and thus radio-activation.

2 Claims, 3 Drawing Sheets

(51) Int. Cl.
*H05H 7/02* (2006.01)
*H05H 7/18* (2006.01)
*H05H 9/04* (2006.01)

(52) U.S. Cl.
CPC ..... *H05H 9/044* (2013.01); *H05H 2007/025* (2013.01)

(58) Field of Classification Search
USPC ..... 315/3.5, 5, 5.41, 507; 219/121.12, 219/121.64; 505/200, 325, 866
See application file for complete search history.

(56) References Cited

U.S. PATENT DOCUMENTS

| | | | | |
|---|---|---|---|---|
| 5,239,157 | A * | 8/1993 | Sakano | H05H 7/20 219/121.64 |
| 5,347,242 | A * | 9/1994 | Shimano | H05H 7/20 315/5.41 |
| 6,873,115 | B2 | 3/2005 | Sagawa et al. | |
| 2009/0302785 | A1* | 12/2009 | Miller | H05H 7/22 315/505 |
| 2013/0012394 | A1* | 1/2013 | Sennyu | H05H 7/20 505/200 |

OTHER PUBLICATIONS

F. Marhauser, "Field Emission and Consequences as Observed and Simulated for CEBAF Upgrade CMs", Proc. of SRF Conference, Paris, France, 2013.
P. H. McGinley, J. C. Landry, Physics in Medicine and Biology, 34, No. 6, p. 777-783, 1989.

* cited by examiner

LINEAR ACCELERATOR ACCELERATING MODULE TO SUPPRESS BACK-ACCELERATION OF FIELD-EMITTED PARTICLES

CROSS-REFERENCE TO RELATED APPLICATIONS

This application claims the benefit of Provisional U.S. Patent Application Ser. No. 62/215,870 filed Sep. 9, 2015.

GOVERNMENT LICENSE RIGHTS STATEMENT

The U.S. Government may have certain rights to this invention under Management and Operating Contract No. DE-AC05-06OR23177 from the Department of Energy.

FIELD OF THE INVENTION

The present invention relates to linear accelerator (linac) accelerating modules and more particularly to a method to suppress back-acceleration of field-emitted particles in RF accelerators.

BACKGROUND OF THE INVENTION

So-called electron loading in radio-frequency (RF) accelerating cavities is the primary cause for cavity performance limitations today. Electron loading can limit the desired energy gain, add cryogenic heat load, damage accelerator components and increase accelerator downtime depending on the induced trip rates. Trip rates are of particular concern for next generation facilities such as Accelerator Driven Subcritical Reactors or Energy Recovery Linacs for Free Electron Lasers.

Electron loading can be attributed to mainly three phenomena, i.e. field emission (FE), multiple impact electron amplification (short: multipacting) and RF electrical breakdown. In all cases, electrons are involved either being released from the enclosing RF surfaces or generated directly within the RF volume by ionization processes with the rest gas (even in ultra-high vacuum), e.g. due to cosmic radiation. The free electrons can absorb a considerable amount of the RF energy provided by external power sources thereby constraining the achievable field level and/or causing operational failures.

Field emission has been a prevalent issue, particularly in superconducting RF (SRF) cavities, whereas RF electrical breakdown and multipacting can be controllable within limits by adequate design choices. Though SRF cavities may readily exceed accelerating fields ($E_{acc}$) of 20 MV/m, the onset of parasitic electron activities may start at field levels as low as a few MV/m. Field emission becomes a major concern when the electrons emitted are captured by the accelerating RF field and directed close to the beam axis through a series of cavities or cryomodules.

The free electrons can then accumulate a comparable amount of energy as the main beam would over the same distance. This can present a considerable 'dark current' with damaging risks (e.g. when hitting undulator magnets). The electrons can be directed either down- or upstream the accelerator depending on the site and time of origin.

FIG. 1 exemplarily shows the energy range of field-emitted electrons numerically computed for an upgrade cryomodule of Jefferson Lab's electron recirculator CEBAF depending on the initial field emitter location along the cryomodule. The upgrade cryomodule, housing eight seven-cell cavities, covers all probable emitter sites seeded around irises, where the electrical surface field peaks ($E_{peak}$). The energies are plotted over the initial 8×8 iris regions covering all possible field emitting surfaces. The 8 sets of data points for each cavity along the x-axis represent same iris regions (1 through 8 for each cavity). A code is given in the legend with C=cavity and I=iris with the corresponding number denoting the site of origin.

The concern with field emission stems from its exponential increase with $E_{acc}$ (the acceleration gradient), which is well verified experimentally. Note that FE is a quantum-mechanical process that can be described by the (simplified) Fowler-Nordheim (FN) equation:

$$J = \frac{I}{A_{eff}} = \frac{(\beta_{enh} \cdot E_{peak})^2}{\phi} \cdot a \cdot 10^{4.52 \cdot \phi^{-0.5}} e^{\frac{0.956 \cdot b \cdot \phi^{3/2}}{\beta_{enh} \cdot E_{peak}}}. \quad (1)$$

J denotes the peak current density (in $A/m^2$) (current I over effective emission area $A_{eff}$), $E_{peak}$ the local surface electrical field (in V/m), Φ the local material work function (in eV), and a and b, which are the $1^{st}$ and $2^{nd}$ FN-constants, respectively ($a \approx 1.541434 \cdot 10^6$ $A \cdot eV \cdot V^{-2}$ and $b \approx 6.83089 - 10^9$ $eV^{-3/2} \cdot V/m$). Field emission requires surface fields in the order of GV/m. Peak fields in SRF cavities however only reach up to a few ten MV/m. Therefore a local field enhancement factor $\beta_{enh}$ is introduced, which in SRF cavities requires $\beta_{enh} > 50$ to produce meaningful emission currents. In fact, such large enhancement factors and higher are often encountered depending on the nature of the field emitter.

Emitted electrons eventually hit surfaces internal or external to cavity cryomodules depending on the site and time of origin, which determines trajectories and energies. Upon impact, electrons not only can create additional heating, but also can induce secondary particle showers and gamma rays via bremsstrahlung. This in turn can cause radio-activation of accelerator components once electrons accumulate energies above the threshold for neutron production, which is in the order of 10 MeV for the metals employed. For instance, very high radiation levels and radio-activation due to FE has been a concern in CEBAF upgrade cryomodules. The primary process for neutron production by electrons is the absorption of bremsstrahlung photons, i.e. via photonuclear reactions. The threshold energy can thus be obtained within a few cavity cells depending on field levels.

Maintaining extremely clean environments throughout cavity fabrication, post-processing and assembly is of major importance to mitigate particulates that may create FE sites. However, the existence of field emitters cannot be excluded even when obeying strict protocols following industrial standards. Based on today's experience a large fraction of SRF cavities remain plagued by FE.

OBJECT OF THE INVENTION

A first object of the invention is to provide a method for suppressing upstream field emission in RF accelerators.

A second object of the invention is to reduce electron loading to improve the performance of radio-frequency (RF) accelerating cavities.

A further object is to reduce the electron loading in order to improve the energy gain, reduce the cryogenic heat load, lessen the damage accelerator components, and reduce accelerator downtime depending on the induced trip rates.

These and other objects and advantages of the present invention will be better understood by reading the following description along with reference to the drawings.

SUMMARY OF THE INVENTION

The present invention is a method for suppressing of upstream-directed field emission in RF accelerators. The method is not restricted to a certain number of cavity cells, but ideally requests similar operating field levels in all cavities to efficiently annihilate the once accumulated energy. Such a field balance is desirable to minimize dynamic RF losses, but not necessarily achievable in reality depending on individual cavity performance (e.g. early $Q_0$-drop or quench field). Yet, even with some discrepancy in operating fields, the method of the present invention can achieve a significant energy reduction for upstream-directed electrons within a relatively short distance. Electrons will then impact surfaces at rather low energies. With the dark current being reduced, so are issues with heating and damage of accelerator components as well as radiation levels including neutron generation and thus radio-activation.

DETAILED DESCRIPTION

The present invention provides a practical method for suppressing FE in accelerating structures even in presence of field-emitting sites. Though important for SRF cavity cryomodules, the method applies generally to any type of RF accelerator. The benefit is a significant reduction of energy accumulation of upstream traveling field-emitted electrons, which mitigates dark current directed to the injector. The method is deemed most efficient for speed-of-light ($\beta$=1) structures accounting for the fact that the electrons are swiftly accelerated to relativistic energies once captured by the RF field such that the travel distance per RF period is nearly equal to that of the main beam. The method is advantageous in that it does not require an alteration of the cavity design. The method includes adjusting the beam tube length ($L_{tube}$) between cavities to obey:

$$L_{tube} = \left(N + \frac{1}{2}\right)\cdot L_{cell} \approx \left(N + \frac{1}{2}\right)\cdot \frac{\beta\lambda}{2}. \quad (2)$$

Herein $L_{cell}$ is the cavity cell length (~$\beta\lambda/2$, $\lambda$=wavelength of accelerating mode) and N is an integer number. $L_{tube}$ is often chosen to be $3\cdot L_{cell}$ in SRF cavity cryomodules. This implies that RF fields in cavities oscillate synchronously at all times. The main beam accelerated in one cavity will then experience the same accelerating field after passage to the next cavity without phase adjustment (theoretically and assuming constant velocity). However, the RF phase can be technically tuned for each cavity depending on the tube length. The cavity interconnecting tube length cannot be chosen arbitrarily small, since it has to accommodate space for fundamental power couplers, pick-up probes for RF feedback control as well as HOM dampers and bellows depending on design requirements.

When applying the method, one also has to take into account isolation requirements between couplers of neighbouring cavities to avoid cross-talk effects that impede the low level RF control. This for instance concerns crosstalk between a power coupler of one cavity and the pick-up probe of the adjacent cavity or two power couplers facing each other. When using stainless steel bellows between cavities, the thermal losses in the bellows favour to place cavity flanges further away from the cavity cells. All the aforementioned considerations usually make N=0 and 1 impractical in SRF cryomodules. For N=2 ($L_{tube}=2.5\cdot L_{cell}$) however one obtains a reasonably long section for practical and thermal requirements, while saving cryomodule length and thus costs compared to $3\cdot L_{cell}$. Otherwise N=3 should be chosen.

Figure 1:
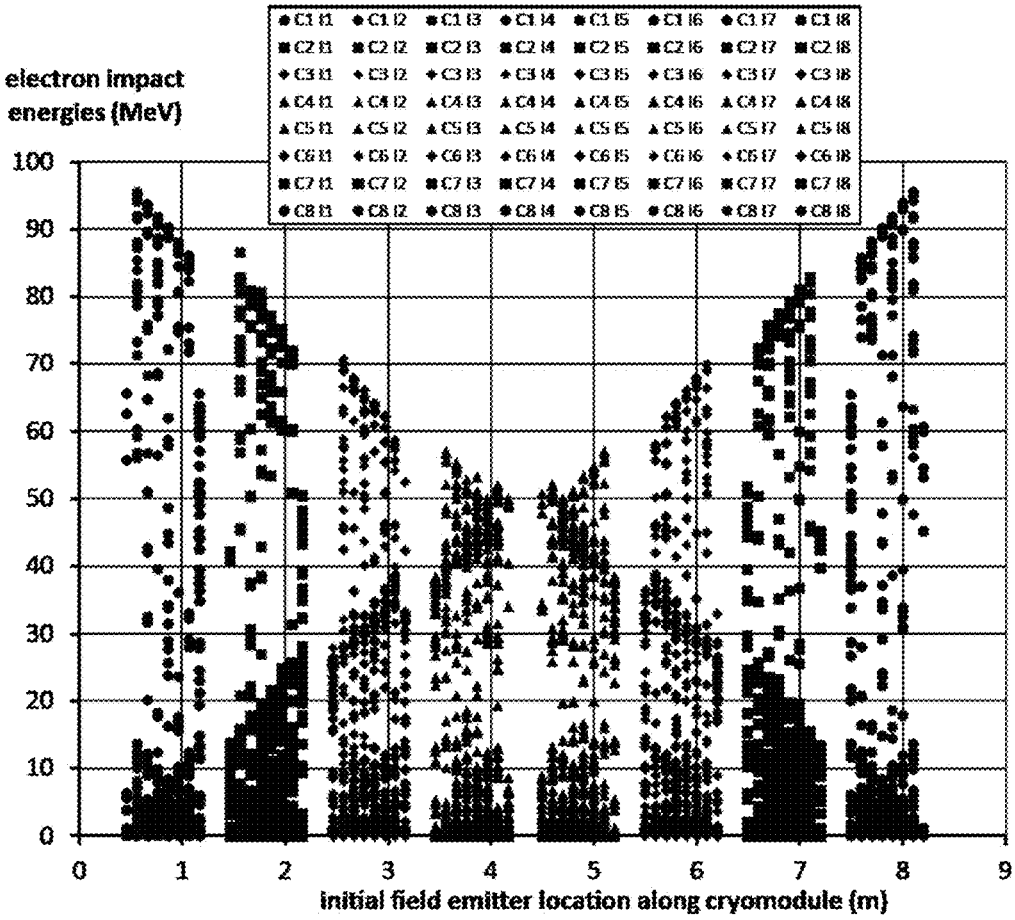
FIG. 1 depicts a possible impact energy range of electrons in an upgrade CEBAF cryomodule having eight seven-cell cavities, with all cavities operating at the nominal field level of $E_{acc}$=19.2 MV/m totaling 108 MeV energy gain. The results are not fully mirror-symmetric due to numerically different start conditions.
Figure 2:
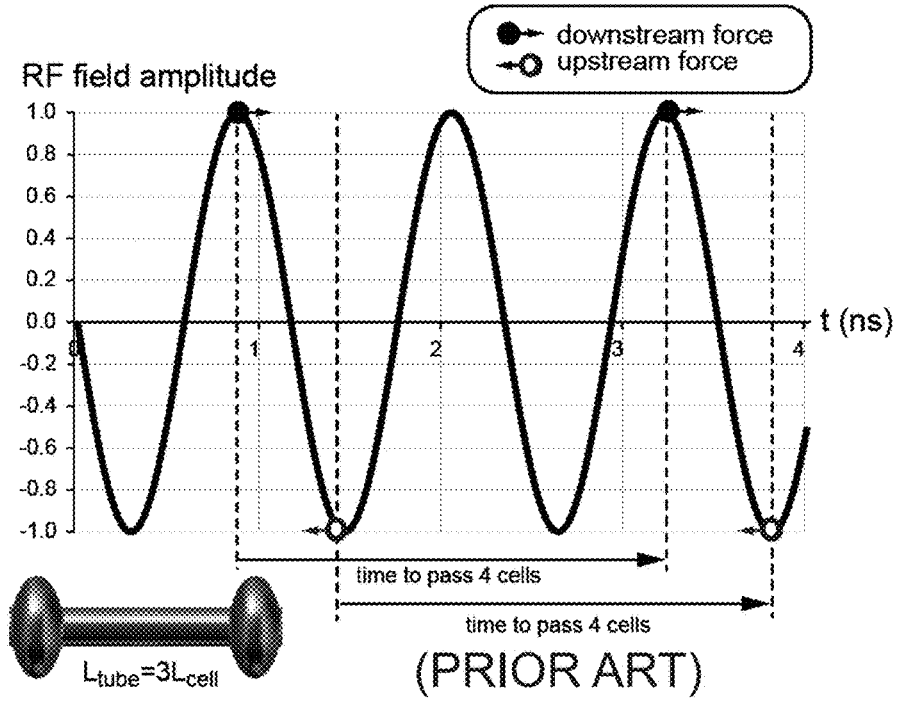
FIG. 2 graphically depicts Normalized RF field amplitudes as a function of time for two adjacent cavities having different intermediate tube lengths, with the top graph depicting a prior art arrangement of adjacent cavities with an intermediate tube length $L_{tube}=3\cdot L_{cell}$ and the bottom graph depicting adjacent cavities in an arrangement according to the present invention with an intermediate tube length $L_{tube}=2.5\cdot L_{cell}$.
Figure 2:
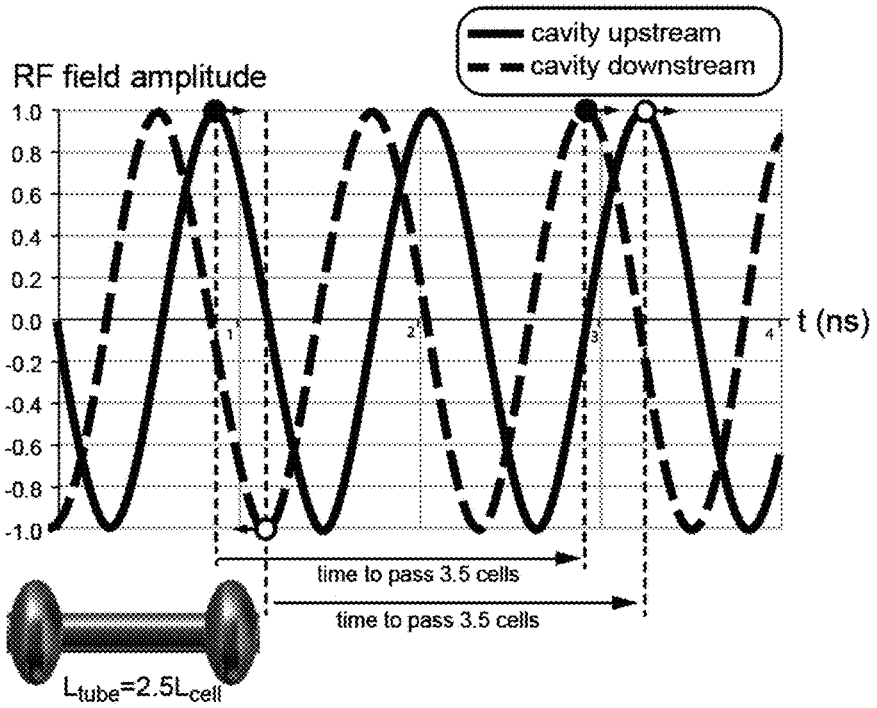

FIG. 2 demonstrates the benefit considering two interconnected cavities for simplicity. It depicts the RF amplitude (normalized) in both cavities as a function of time when utilizing $L_{tube}=3\cdot L_{cell}$ and $L_{tube}=2.5\cdot L_{cell}$, respectively. In a prior art arrangement such as shown in the top plot of FIG. 2, in which $L_{tube}=3\cdot L_{cell}$, there is no phase difference between the RF field amplitudes of the cavities (top plot). The main beam is represented by filled dots. The first bunch (leftmost filled dot) occupies one of the possible RF buckets at the chosen start time. At this moment one may imagine that the bunch center is in the mid of the last cell of the upstream cavity when the field just peaks (+1). This yields maximum acceleration downstream. After traveling a time corresponding to a length of $L=L_{tube}+L_{cell}$ the bunch will pass the center of the $1^{st}$ cell of the subsequent cavity ($2^{nd}$ filled dot) experiencing an accelerating field again (+1).

Field-emitted electrons moving downstream would be accelerated in the same way once efficiently captured by the RF assuming no significant phase slippage occurs. Electrons directed upstream will have to start when the field peaks in the opposite direction (−1) corresponding to a 180° phase shift to the accelerating field in the same cell. Assuming this to be the time when field-emitted electrons arrive in the mid of the $1^{st}$ cell in the downstream cavity (leftmost unfilled dot), these will reach the end cell of the upstream cavity when the field peaks again for further acceleration upstream (−1 at $2^{nd}$ unfilled dot). Consequently in this case ($L_{tube}=N\cdot L_{cell}$), electrons may accumulate the same energy gain whether directed up- or downstream.

Referring to the bottom plot of FIG. 2, for the case when $L_{tube}=2.5\cdot L_{cell}$ the RF phase of the downstream cavity (dashed curve) has to be adjusted in order to be synchronous with the main beam (filled dots). This requires a relative RF phase shift of 90° with respect to the upstream cavity (solid curve). Field-emitted electrons directed downstream would still experience energy accumulation as in the former case. However, field-emitted electrons originating in the downstream cavity will have to start when the field peaks in opposite direction (−1). If we assume the $1^{st}$ unfilled dot (leftmost) corresponds to the time the electrons are located in the center of the $1^{st}$ cell of the downstream cavity—not restricting generality—then by the time the electrons travel to the end cell of the upstream cavity the RF field will be decelerating (+1). Therefore, field-emitted electrons directed upstream in the way described above will lose all the energy accumulated previously.

Note that in reality field-emitted electrons are emitted during a finite phase range. This causes differing trajectories and energy spread among particles. Perfect energy annihilation cannot be achieved for all possible trajectories.

Trajectories also depend on the specific cavity shape. The proposed method however provides a significant reduction of upstream energies in all conceivable cases when obeying equation (2).

Figure 3:
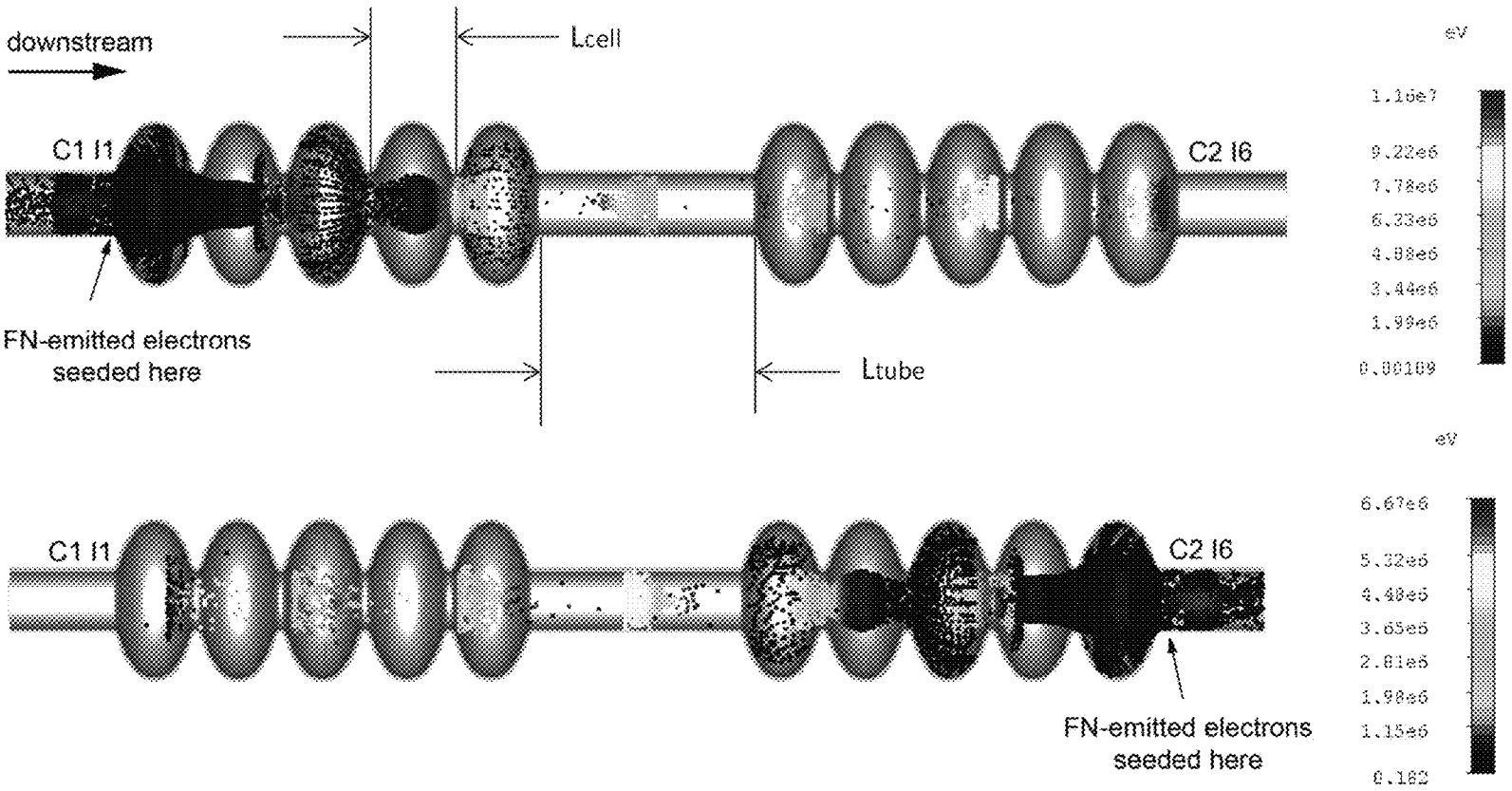
FIG. 3 is a schematic depicting electrons traveling through two five-cell cavities, which are phased to provide maximum energy gain for the main beam. The top schematic depicts electrons continuously field-emitted at the $1^{st}$ iris of cavity 1 (C1 I1). The bottom schematic depicts electrons continuously field-emitted at the last iris of cavity 2 (C2 I6).

FIG. 3 illustrates two numerical case studies for a string of two five-cell cavities. The difference is only the initial FE region. In both cases electrons are seeded into the RF volume according to the Fowler Nordheim equation covering several RF cycles sufficient for electrons to pass the full string. It allows electron bunches being emitted over a relatively wide phase space at times when the field peaks. The shading intensity within the cavities corresponds to the electron energy as denoted in the legends. The cavity interconnecting tube length is $L_{tube}=2.5.1\cdot_{cell}$ The RF frequency is 1.5 GHz yielding an active length of ~0.5 m for a single cavity. Both cavities are operating at $E_{acc}=12.5$ MV/m corresponding to 6.25 MeV energy gain per cavity. The cavities in both cases are phased such that a main bunched beam at $\beta=1$ would experience the maximum energy gain of 12.5 MeV passing both cavities. In the upper plot the field-emitters symmetrically occupy the region around the $1^{st}$ iris of cavity 1 upstream (C1 I1). Here, those electrons captured close to the beam axis experience an energy gain of 11.6 MeV at the exit of cavity 2, slightly short of the 12.5 MeV feasible, which is a consequence of the particles emitted only with a few eV at the surface. In the bottom plot the seeding site is around the last iris of cavity 2 (C2 I6). Now only cavity 2 provides ideal conditions for acceleration in upstream direction with the maximum energy reached within the beam tube, whereas cavity 1 decelerates the beam. Some electrons come to almost a complete stop at the exit of cavity 1 (upstream) and present the least harm with regard to electron loading effects. This is in principle agreement with the simplified analytical approach depicted in FIG. 2. Some electrons initially dragging behind the leading particles however can exhibit a large phase slippage and are therefore not as efficiently decelerated. These may accumulate a few MeV energy again within cavity 1, which is yet significantly lower than in case of $L_{tube}=N\cdot L_{cell}$. Furthermore, the maximum energy accumulated is likely to decrease in a longer chain of cavities for the same particles as long as $L_{tube}=(N+1/2)\cdot L_{cell}$.

Although the description above contains many specific descriptions, materials, and dimensions, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A method for suppressing prevalent field emission in the upstream direction in a superconducting radio frequency (RF) accelerator, comprising:

providing an accelerator structure including a plurality of independently phased multi-cell cavities in a string;

providing an intermediate beam tube having a beam tube length between each of the multi-cell cavities wherein the beam tube length of the intermediate beam tube between the multi-cell cavities is determined according to the following equation $$L_{tube}=\left(N+\frac{1}{2}\right)\cdot L_{cell}\approx\left(N+\frac{1}{2}\right)\cdot\frac{\beta\lambda}{2}.$$

wherein $L_{tube}$ is the beam tube length between cavities, $L_{cell}$ is the length of the cells in each multi-cell cavity, $\beta$ is the particle velocity relative to the speed of light, $\lambda$ is the wavelength of the accelerating mode, and N is an integer number;

injecting a stream of electrons into said accelerator structure; and applying an accelerating field of at least 3 MV/m to accelerate the electrons to a relativistic speed.

2. A superconducting radio frequency (RF) accelerator structure comprising:

a plurality of independently phased multi-cell cavities in a string;

an intermediate beam tube having a beam tube length between each of the multi-cell cavities;

wherein the beam tube length of the intermediate beam tube between the cavities is determined according to the following equation $$L_{tube}=\left(N+\frac{1}{2}\right)\cdot L_{cell}\approx\left(N+\frac{1}{2}\right)\cdot\frac{\beta\lambda}{2}.$$

wherein $L_{tube}$ is the beam tube length between cavities, $L_{cell}$ is the length of the cells in each multi-cell cavity, $\beta$ is the particle velocity relative to the speed of light, $\lambda$ is the wavelength of the accelerating mode, and N is an integer number.

* * * * *